United States Patent [19]

Mitani et al.

[11] 4,294,081

[45] Oct. 13, 1981

[54] FREEZING REFRIGERATOR

[75] Inventors: Akio Mitani; Moriyoshi Sakamoto, both of Yokohama; Hiroaki Murasaki, Ibaraki, all of Japan

[73] Assignee: Tokyo Shibaura Denki Kabushiki Kaisha, Kawasaki, Japan

[21] Appl. No.: 33,978

[22] Filed: Apr. 27, 1979

[51] Int. Cl.[3] ..... F25D 21/02; F25B 5/00

[52] U.S. Cl. ..... 62/140; 62/151; 62/283

[58] Field of Search ..... 62/140, 150, 151, 283, 62/276, 80

[56] References Cited

U.S. PATENT DOCUMENTS

| | | | |
|---|---|---|---|
| 2,449,824 | 9/1948 | Shoemaker | 62/283 X |
| 2,705,874 | 4/1955 | Binder et al. | 62/276 X |
| 3,096,629 | 7/1963 | Rembold | 62/283 |
| 3,108,450 | 10/1963 | Crotser | 62/283 X |
| 3,946,286 | 3/1976 | Kinnunen et al. | 62/151 X |

*Primary Examiner*—William E. Wayner

*Assistant Examiner*—Harry Tanner

*Attorney, Agent, or Firm*—Oblon, Fisher, Spivak, McClelland & Maier

[57] ABSTRACT

A freezing refrigerator has a freezing chamber for accommodating food to be freezed and a cold chamber for accommodating food kept at low temperature, those chambers being separated by a heat insulative member and provided with doors, respectively. The cold chamber is provided therein a cold chamber cooler for cooling the inside thereof and the freezing chamber is provided therearound with a first freezing chamber cooler for cooling the inside therein. A second freezing chamber cooler is provided close to the rear side of the freezing chamber but is separated from the inner surface of the freezing chamber. The surface temperature of the second cooler is kept lower than that of the first freezing chamber cooler. A shield plate is further provided to blind one from seeing the second cooler when the door for the freezing chamber is open, the shield plate being disposed close to the second cooler.

8 Claims, 9 Drawing Figures

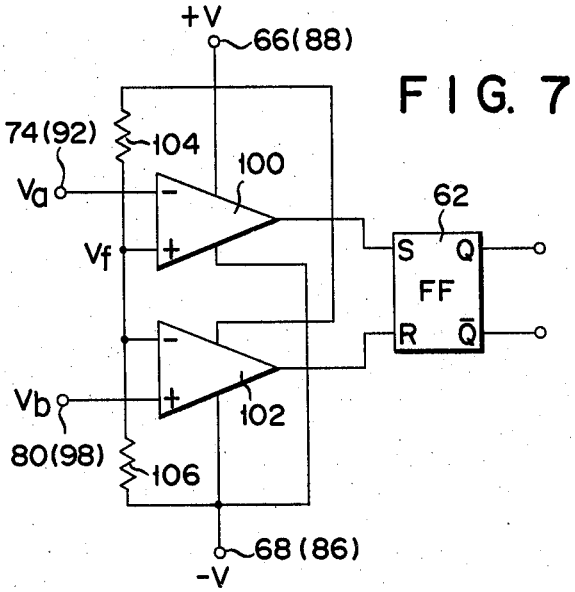
FIG. 7
FIG. 8
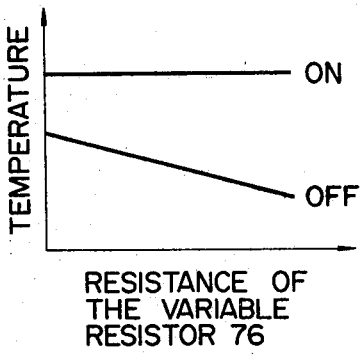
FIG. 9
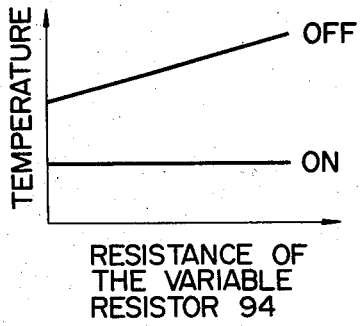

FREEZING REFRIGERATOR

BACKGROUND OF THE INVENTION

This invention relates to a freezing refrigerator of a direct cooling type and, more particularly, a freezing refrigerator with a defroster.

Generally, a home-used refrigerator is provided with a freezing chamber and a cold chamber, and is classified into a direct cooling type refrigerator and an indirect cooling type refrigerator. The indirect cooling type refrigerator circulates a cooling air through the freezing chamber and the freezing cooler to indirectly cool the freezing chamber. The direct cooling type refrigerator employs a substantially rectangular box made of good thermally conducting material for the freezing chamber with a freezing cooler disposed therearound to directly uniformly cool most of the entire interior of the freezing chamber. The direct type refrigerator directly cools the freezing chamber so that, during the cooling operation, frost is attached to almost the entire inner surface of the freezing chamber. The attached frost adiabatically acts to reduce the cooling effect.

It is the practice to defrost the frost-attached freezing chamber in a manner that food in the freezing chamber is taken out and the inside of the freezing chamber is heated to room temperature, after stopping the freezing operation. This defrosting method probably thaws the frozen food and needs a troublesome work to stop the freezing operation and take out the frozen food from the freezing chamber. Coping with this problem, there is proposed a refrigerator with a heater for defroster which is disposed, together with the freezing cooler, around the freezing chamber and is supplied with power when necessary. This method indeed defrosts the frost attached onto the inner wall of the freezing chamber reliably and swiftly; however, there is a high possibility that the frozen food is defrozen. For this reason, the frozen food must temporarily be taken out from the freezing chamber for defrosting operation.

SUMMARY OF THE INVENTION

Accordingly, the primary object of the invention is to provide a freezing refrigerator which can defrost the frost attached onto the freezing chamber without removing frozen food therefrom for defrosting.

In brief, the present invention may be summarized as a freezing refrigerator comprising a freezing chamber for accommodating objects to be kept in a frozen state, first and second coolers for cooling the interior of the freezing chamber, and a coolant supply system for supplying coolant to these coolers. The second cooler has a lower surface temperature than the first cooler in order to move the frost formed on the inner surface of the freezing chamber to the second cooler.

The other objects and novel features of the invention will be more apparent as the description proceeds, when considered with the accompanying drawings in which:

FIG. 7 shows a circuit diagram of one of the control signal generating circuit shown in FIG. 6; and FIGS. 8 and 9 each shows a graph illustrating a relation of ON and OFF temperatures to a resistance of the variable resisger shown in FIG. 6.

DETAILED DESCRIPTION OF THE PREFERRED EMBODIMENT

Figure 1:
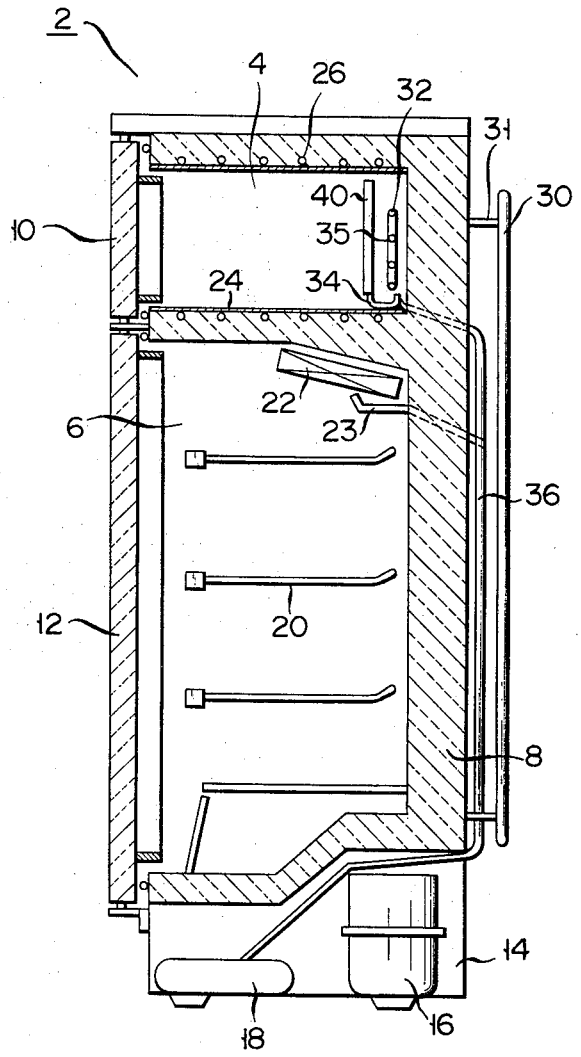
FIG. 1 shows a longitudinal cross sectional view of an embodiment of a freezing refrigerator according to the invention.
Figure 2:
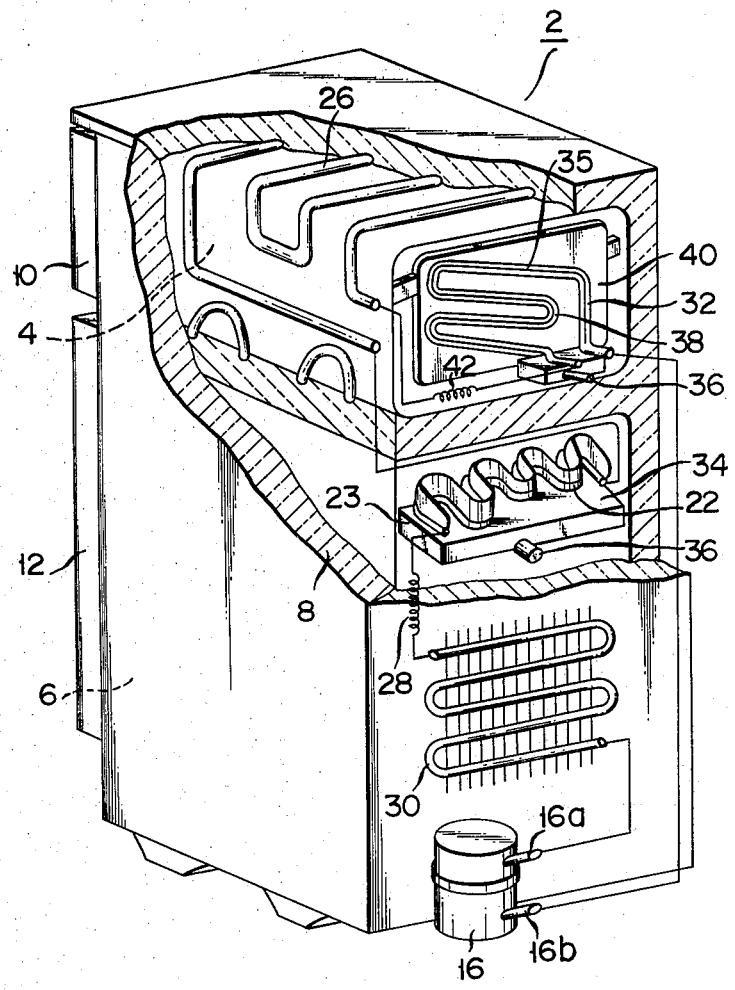
FIG. 2 shows a perspective view of the refrigerator according to the invention which is illustrated partly broken as viewed from the rear side of the refrigerator.

Reference will first be made to FIG. 1 illustrating a longitudinal cross section of a freezing refrigerator according to the invention. A refrigerator 2 is provided with a freezing chamber 4 located at the upper side and kept at a low temperature, for example, below 18° C., preferably below 0° C., and a cold chamber 6 located at the lower side and kept at a higher temperature than that of the freezing chamber 4. Those two chambers are covered with a heat insulative member 8 such as foamed polystyrene. A door 10 for the freezing chamber 4 is hinged at one of the sides of the opening of the chamber 4 opened toward the freezer front side. Similarly, another door 12 for the cold chamber 6 is hinged at one of the sides of the opening of the chamber 6 opened toward the cold chamber front side. The lower most chamber 14 houses a compressor motor 16 for compressing gas coolant for conversion into high pressure and high temperature gas coolant, and an evaporation dish 18 for temporarily storing water to evaporate it. Provided within the cold chamber 6, a plurality of racks 20 supports foods to be kept at low temperature and a cooler, or an evaporator 22 for the cold chamber 6 cools the interior of the chamber 6 to a necessary low temperature. Waterdrops attached onto the cooler 22 are collected into a dish 23 disposed under the right hand side of the cooler as viewed in the drawing. In this embodiment, the freezing chamber 4 is formed by curving a good thermal conductive metal plate 24 into a substantially rectangular box. A first cooler 26, or an evaporator, for cooling the freezing chamber buried in the thermal insulative material 8 is intimately disposed on the outer surface of the metal box 24. Supplied to the coolers 22 and 26, liquid coolant with low pressure at room temperature are evaporated therein to absorb heat from the atmosphere in the vicinity of the coolers 22 and 26 thereby finally to cool the inside of the chamber. As shown in FIG. 2, the inlet of the cold chamber cooler 22 is coupled with one end of a first capillary tube 28 which converts liquid coolant supplied with high pressure at room temperature into liquid with low pressure at room temperature for supply to the cooler 22. The output of the cold chamber cooler 22 is coupled with the inlet of the first freezing chamber cooler 26. The other end of the capillary tube 28 is jointed to the output side of a condenser 30 which radiates heat from gas coolant with high pressure at high temperature supplied from the compressor motor 16 to convert it into saturated liquid compressed with high pressure at high temperature. The condensor 30, fixed to the rear wall of the refrigerator 2 by means of the holder 31, is jointed at the input side to the compressed gas discharging port 16*a* of the compressor motor 16.

Figure 3:
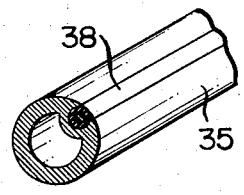
FIG. 3 shows in cross sectional manner a part of a pipe forming a second freezing chamber cooler which is provided in a freezing chamber of the refrigerator which is an embodiment of the invention.

The freezing refrigerator according to the invention further has a second cooler 32, or an evaporator for the freezing chamber 4, disposed closer to the rear inner wall of the freezing chamber 4. The second cooler 32 serves as a defroster for defrosting frost formed on the inner wall of the metal box 24, or the freezing chamber 4. As shown, the second cooler 32 is arranged closer to the rearmost inner wall of the freezing chamber 4 but not in contact with that surface. The second cooler 32 is a zig-zag pipe 35 in this embodiment, with a slant of such a degree to permit waterdrops formed thereon to flow therealong into a dish 34 provided under the pipe 35. The dishes 34 and 23 are coupled with the dish 18 in the chamber 14, by means of drain pipes 36. As shown in FIG. 3, an electric heater 38 for defrosting the frost formed thereon is fitted along the pipe 35 of the cooler 32. Preferably, this heater 38 is fitted on the outer surface of the pipe 35 closer to the rear side of the freezing chamber 4, in order to avoid the heat transmission from the heater 38 to the frozen food as small as possible. A blind board 40 which is open around its periphery except for its mounting is disposed in front of the cooler 32, with double functions; one is to blind one from seeing nuisance cooler arrangement, when the door 10 is open, and the other is to shield the frozen food from the heat radiation from the heater 38 of the pipe 35. Therefore, it is preferable that heat insulative material is used for preventing the heat radiation and the frost forming on the blind board per se. A second capillary tube 42 is coupled between the coolant outlet of the freezing chamber cooler 26 and the coolant inlet of the second freezing chamber cooler 32. The coolant outlet of the freezing chamber cooler 32 is coupled through a pipe line to the inlet 16*b* of the compressor 16.

Although not shown in FIGS. 1 and 2, a temperature detector such a thermistor for detecting the surface temperature of the cold chamber cooler 22 is provided at the rear side of the cold chamber 6. Similarly, another temperature detector for detecting the thickness of frost formed on the freezing chamber 32 is provided at the rear side of the freezing chamber 4. This will be described later with reference to FIGS. 4 to 6.

Figure 4:
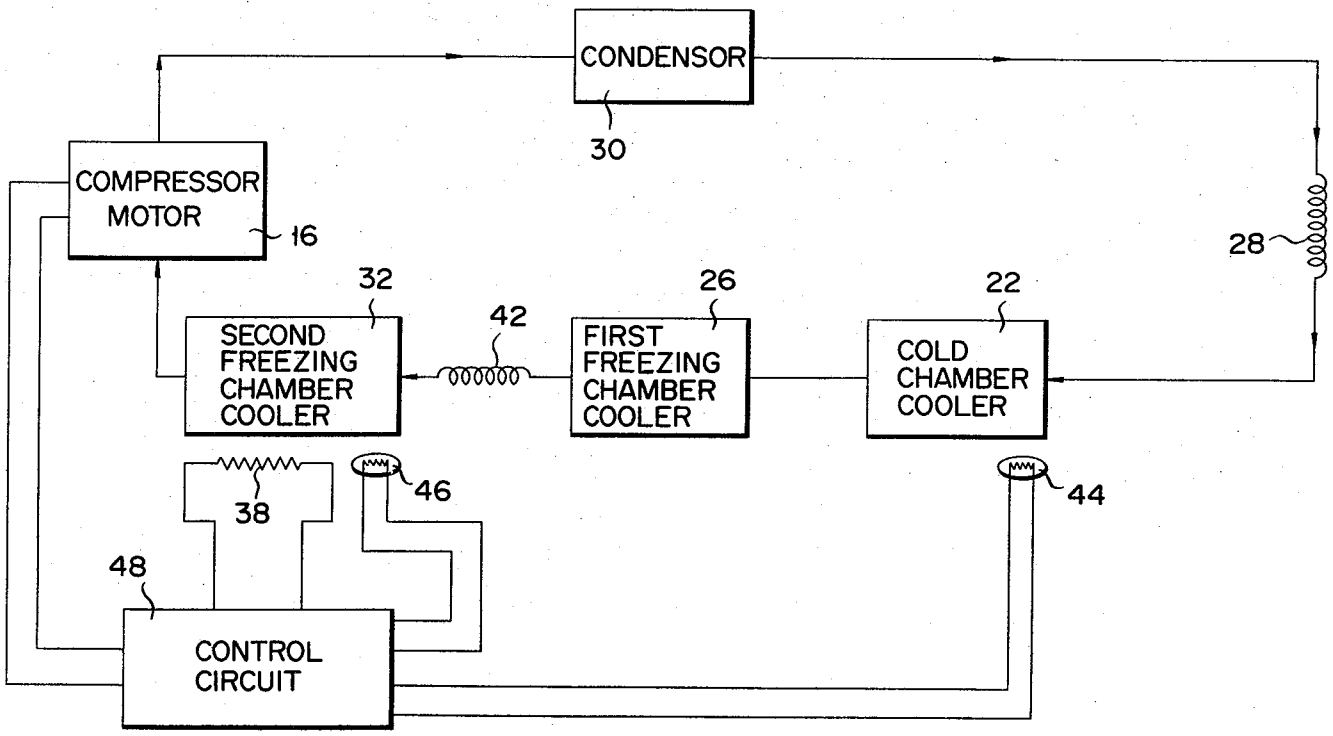
FIG. 4 shows a circuit diagram illustrating a cooling cycle of the refrigerator according to the invention.

Turning now to FIG. 4, there is shown a circuit diagram of a cooling cycle of the refrigerator shown in FIGS. 1 and 2. As shown, the compressor 16 is coupled with the condensor 30 which in turn is coupled through the first capaillary tube 28 to the cold chamber cooler 22. The cold chamber cooler 22 connected to the first freezing chamber cooler 26 is connected through the second capillary tube 42 to the freezing chamber cooler 32 which is further connected to the compressor motor 16. Such a connection of those components forms a coolant cyclic route. The temperature detector 44 for measuring the surface temperature of the cooler 22 is disposed near the cold chamber cooler 22 and the temperature detector 46 for measuring the thickness of the frost on the surface of the second freezing chamber cooler 32 are disposed near the cooler 32. These temperature detectors controls a current flow into the electric heater 38, through a control circuit 48 for controlling the temperature and frost. The control circuit 48 is connected to the detectors 46 and 44 and also to the power supply terminals of the compressor 16.

In operation, when the compressor 16 is driven, liquid coolant passed through the condensor 30 and the capillary tube 28 flows into the cold chamber cooler 22 disposed in the cold chamber 6 where it is partly evaporated to cool the cold chamber. The coolant leaving the cooler 22 flows into the first freezing chamber cooler 26 intimately attached around the peripheral wall where it is evaporated again to cool the freezing chamber 4. The coolant passed through the cooler 26 is reduced in its pressure and then enters the cooler 32 where it is evaporated to cool the interior of the freezing chamber 4, and finally returns to the compressor motor 16. At this time, the pressures of the liquid medium flowing through the cold chamber cooler 22 and the first freezing chamber cooler 26 are approximately equal to each other, so that the surface temperatures of the respective coolers are substantially equal. The coolant pressure-reduced by the capillary tube 42 flows through the cooler 32 so that the pressure reduction of the coolant lowers the surface temperature of the second freezing chamber cooler 32 below that of the first freezing chamber cooler 26. The reason for this is that Freon is used for the coolant and therefore, as the pressure is lower, the coolant is more easily evaporated.

In the example to be given, Freon R-12 is used for the coolant. Freon R-12 is compressed by the compressor 16 to be high temperature gas of about 10 kg/cm$^2$ and then is fed into the condensor 30 where is heat-radiated to be of liquid state. The liquid coolant is pressure-reduced by the capillary tube 28 to be at about 1.2 kg/cm$^2$ and then enters the cooler 22 and cooler 26 so that its surface temperature becomes about −25° C. and hence the coolant absorbs heat from the cooler chamber 4 and the freezing chamber 6 to evaporate. The cooling surfaces of the coolers are so designed that the temperature in the chamber 4 is about −20° C. and the temperature in the cooler chamber 6 is +3° C. The remaining liquid coolant passed through the first freezing chamber cooler 26 is further pressured-reduced by the second capillary tube 42 to be at 1.0 kg/cm$^2$ and then enters the second freezing chamber cooler 32 so that the surface temperature of the cooler 32 becomes approximately −30° C. Also, the second cooler 32 absorbs heat from the inside of the freezing chamber 4. The liquid coolant evaporates to be gaseous state and then returns to the compressor 16.

When the temperature in the freezing chamber 4 of the refrigerator 2 operated in such a cooling cycle falls below 0° C., frost is formed to attach onto the inner wall or the food accommodated. As described above, the freezing chamber 4 of the refrigerator according to the invention is provided additionally with the second freezing chamber cooler 32 of which the surface temperature is lower than that of the first freezing chamber cooler 26. Accordingly, the frost formed on the cooler 26 of which the surface temperature is higher than that of the second cooler or the food is gradually sublimed to evaporated and the evaporation moves toward the second cooler 32 where it is collectively attached onto the second cooler 32.

Generally, it is considered that the frost is formed in the refrigerator resulting from the fact that the water in the chamber is cooled by the cooler to be frozen. In the refrigerator 2 according to the invention using Freon R-12, the surface temperature Ts1 of the cooler 26 of the cooler 4 is −25° C. and the surface temperature Ts2 of the cooler 32 is −32° C. As a result of the opening of the door 10, exterior air is entered into the freezing chamber 4 and the temperature Ta in the freezing chamber 4 rises to be 25° C. In such a case, a temperature difference between the temperature Ta, and Ts1 and Ts2 is large so that the thickness of the frosts formed on the inner surface of the metal box 24 with the cooler 26 intimately attached therearound, i.e. the inner surface of the freezing chamber 4, and the second cooler 32, are substantially equal to each other. Accordingly, the water of the air in the chamber is frosted on the inner wall of the freezing chamber and the first cooler 26 and is evaporated again an in turn is cooled by the second cooler 32 of lower temperature to be frosted on the cooler surface. An amount of the frost moved from the first cooler 26 to the second cooler 32 is given by the following equation $$G=\rho\cdot D\cdot 1/1-w\times dw/dy \quad (1)$$

where G: the amount of first moved from the first cooler 26 to the second cooler 32 ($g/m^2h$), $\rho$: the specific weight ($kg/m^2$), D: diffusion coefficient, w: the absolute humidity of humidified air ($kg/m^3$) and y: length (m).

Figure 5:
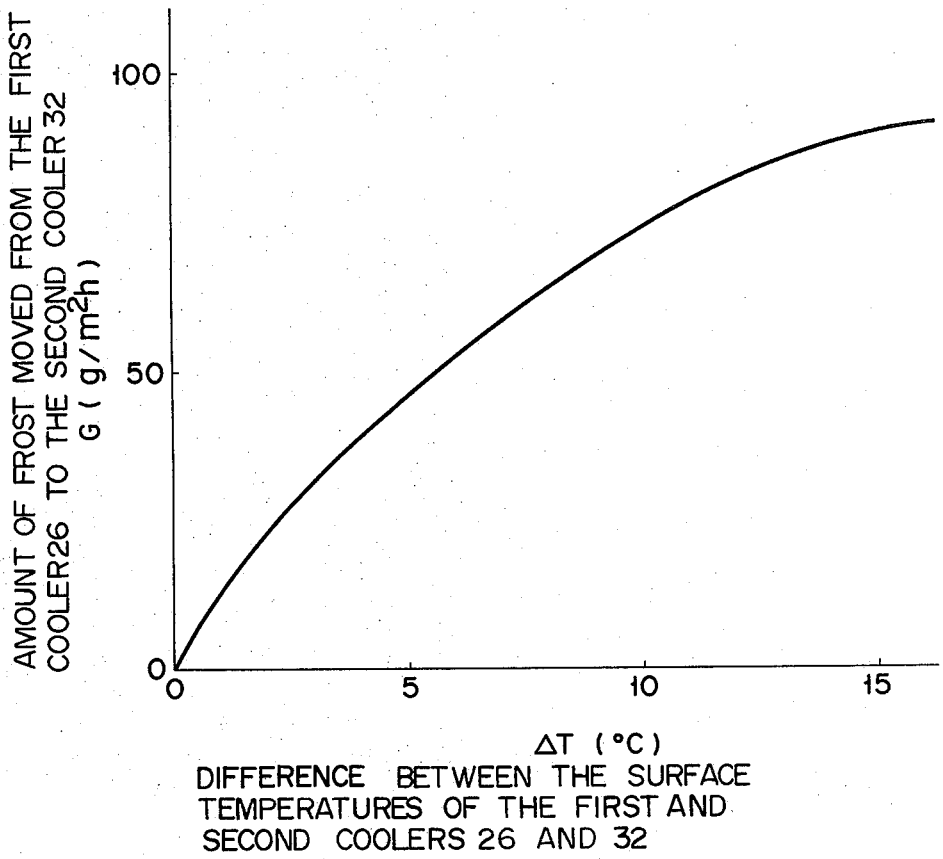
FIG. 5 shows a graph depicting a relation of a temperature difference between first and second freezing chamber coolers to a movement amount G of frost.

FIG. 5 shows a variation of frost movement G with respect to a difference $\Delta T$ between the surface temperatures Ts1 and Ts2 of the first and second coolers 26 and 32, with Ts1$=-25°$ C., in accordance with the equation (1). When the heat transfer area A on the air side of the second cooler 32 is 0.04 $m^2$, and a temperature difference $\Delta T$ is 5° C., we have approximately 50 g for an amount of frost of the second cooler 32 per day, from the charateristic shown in FIG. 5. In a refrigerator with a freezing chamber 4 of 53 liter volume, a defrosting amount necessary a day is generally about 15 g. Accordingly, if the temperature difference $\Delta T$ is set up at 5° C. or more by using the low temperature evaporator according to the invention, all the frost formed within the cooler chamber 4 may be concentrated on the surface of the second cooler 32. When the surface of the second cooler 32 has a given thickness of frost, the frost formed comes in contact with the temperature detector 46 close to the second cooler 32 shown in FIG. 4. As a result, the detected temperature of the temperature detector 44 lowers and this fact is applied to the control circuit 48 so that the control circuit 48 starts to supply power to the electric heater 38. As a result, the frost is defrosted to fall as waterdrops onto the dish 34. The water collected flows into the dish 18 through the drain pipe 36, and then in evaporated. After the frost of the second freezing chamber cooler 32 is defrosted, the detected temperature by the temperature detector 44 rises so that the control circuit 48 stops power supply to the electric heater 38.

Figure 6:
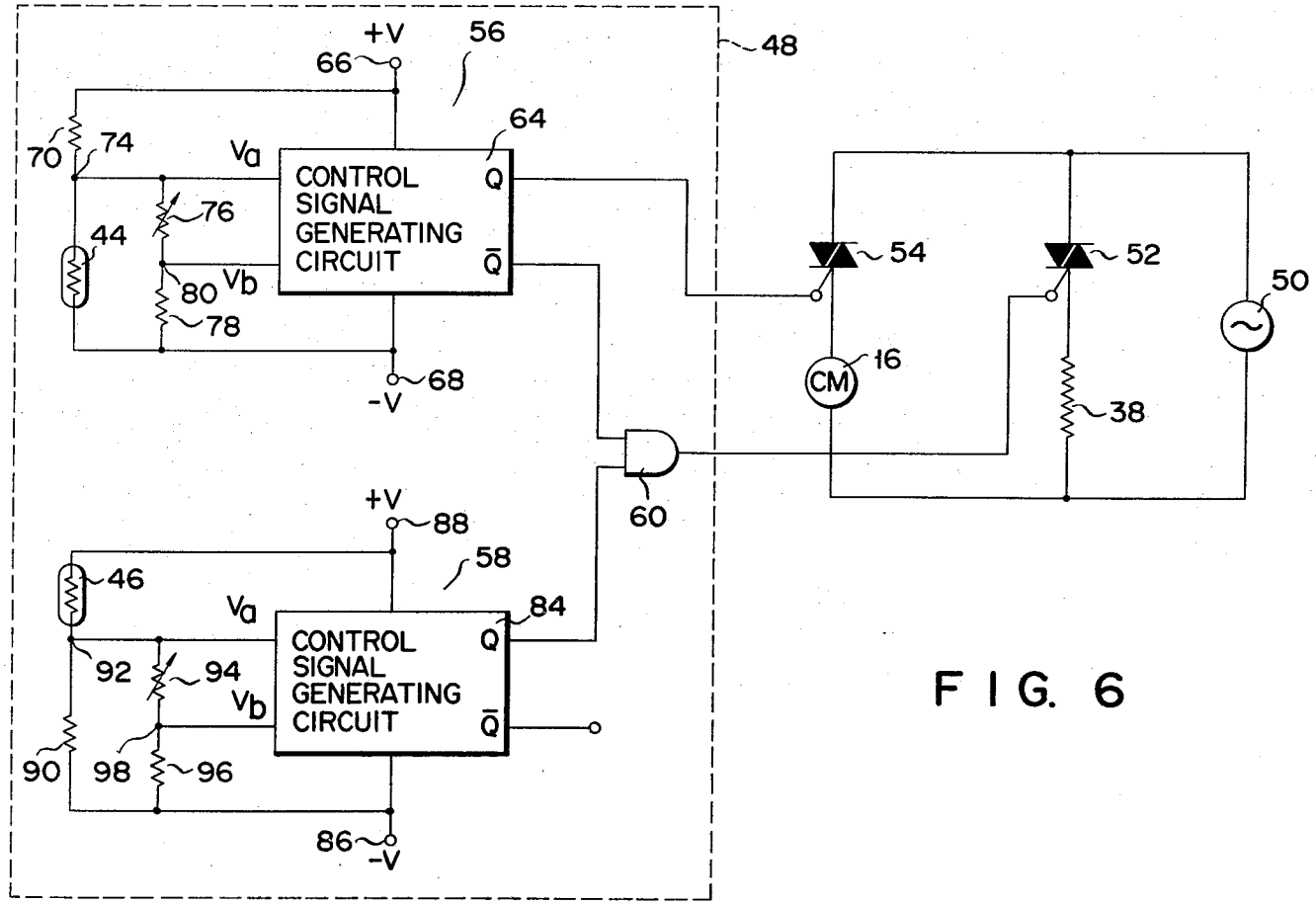
FIG. 6 shows a circuit diagram of one of the control circuits shown in FIG. 4.

A specific example of the control circuit 48 will be described with reference to FIGS. 6 and 7. FIG. 6 shows a circuit diagram of a constant cut-in temperature control system with an automatic defrosting function. As shown in FIG. 6, a power source 50 is connected in parallel with a series circuit including a triac 52 and an electric heater 38 and another series circuit including a triac 53 and a compressor motor 16. The triac 52 is controlled on the basis of a detected signal of a thermistor 46 detecting the frost thickness of the freezing chamber cooler 4. The triac 54 is controlled on the basis of a detected signal of a thermistor 44 detecting the room temperature within the cold chamber 6. When the frost thickness exceeds a predetermined value, the heater 38 is conductive to effect the defrosting operation. When the room temperature in the cold chamber 6 exceeds a predetermined value, the compressor motor 16 is driven so that the coolant flows into the second freezing chamber cooler 32 so that the room temperature in the cold chamber 6 lowers.

The control circuit 48 with such a control function is comprised of a temperature control circuit 56 for providing a control signal to the triac 54 to control the compressor motor 16 and defrosting circuit for providing a control signal to the triac 52 to control the heater 38. The temperature control circuit 56 is further comprised of a control signal generating circuit 64 with output terminals Q and $\overline{Q}$, a thermistor 44, resistors 70 and 78, and a variable resistor 76. The output terminal Q of the control signal generating circuit 6 is connected to the gate of the triac 52 while the output terminal $\overline{Q}$ is connected to the input of an AND gate 60 which is connected at the output terminal to the gate of the triac 52. The control signal generating circuit 60 is connected to a +V power source 66 and a −V power source 68. Between the power source 66 and 68 is connected a series circuit having the resistor 70 and the thermistor 44. The node 74 between the resistor 70 and the thermistor 44 is connected to a temperature detecting circuit 64. A node 74 and the −V power source 68 have therebetween a series circuit including the variable resistor 76 and the resistor 78. The node 80 between the resistors 76 and 78 is also connected to the control signal generating circuit 64. The defrosting control circuit 58 is comprised of a control signal generating circuit 84 with output terminals Q and $\overline{Q}$, a thermistor 46, resistors 90 and 96 and a variable resistor 94. The output terminal Q of the control signal generating circuit 84 is connected to another terminal of the AND gate 60. The control signal generating circuit 84 is connected to a −V power source 86 and a +V power source 88. A series circuit including the thermistor 46 and the resistor 90 is connected between the −V power source 86 and the +V power source 88. A node 92 therebetween is connected to the control signal generating circuit 84. The node 92 and the −V power source 86 have therebetween a series circuit including the variable resistor 94 and the resistor 96. A node 98 therebetween is connected to the control signal generating circuit 84.

Each of the control signal generating circuit 64 and 84 has a circuit as shown in FIG. 7 comprising a flip-flop 62 with output terminals Q and Q, first and second voltage comparators 100 and 102, and resistors 104 and 106. The output of the first voltage comparator 100 is connected to the set terminal of the flip-flop 62 and the output of the second voltage comparator 102 is connected to the reset terminal of the flip-flop 62. The noninverted input terminal (+) of the first voltage comparator 100 and the inverted input terminal (−) of the second voltage comparator 102 are commonly connected to each other and then is connected through the resistor 104 to the +V power source 66 or 88 and to the −V power source 68 or 86 through the resistor 106. To the common connection point $V_f$ is applied a comparing voltage $V_f$. The inverted input terminal (−) of the first voltage comparator 100 is connected to the node 74 or 92 which provides a given detecting voltage Va (referred to as simply an ON voltage Va) when the temperature reaches ON temperature to make the triac 52 or 54 conductive. The non-inverted input terminal (+) of the second voltage comparator 102 is connected to the node 80 or 98 providing a given Vb (referred to as an OFF voltage Vb) when the temperature reaches an OFF temperature rendering the triac 52 or 54 nonconductive. The first and second voltage comparator 100 or 102 is connected to the +V power source 66 or the −V power source 68 or 86.

The operation of the control signal generating circuit 64 or 84 will be described with reference to FIG. 7. In the embodiment, shown in FIG. 7, assume that the resistance ratio of 104 to 106 is 1:1. Under this condition, the reference voltage level $V_f$ of the first or second voltage comparator 100 or 102 is ½ of the power source voltage (+V−−V). The ON voltage Va applied to the node 74 or 92 is below the reference voltage $V_f$, the flip-flop 62 is set and when the OFF voltage $V_b$ applied to the node 80 or 98 is above the reference voltage $V_f$, the flip-flop 62 is reset. Accordingly, if the reference voltage $V_f$ of the voltage comparator 100 or 102 is properly set against the detected voltage $V_a$ or $V_b$ of the temperature detector circuit, a control signal may be generated.

The control operation when an automatic defrosting control is applied to the constant cut-in temperature control, will be described with reference to FIG. 6.

The voltage applied to the node 74 connecting to the temperature control detecting circuit 64 change depending on the resistance change of the thermistor 44, irrespective of the resistance of the variable resistor 76. Specifically, as temperature rises, the resistance of the thermistor 25 decreases (the temperature in the freezing chamber 6 rises) and the voltage across the thermistor 44 comes down so that the potential at the node 74 approaches to the potential of the negative power source −V. At this stage, the voltage level applied to the node 74 comes down becomes the reference voltage $V_f$ so that the output terminal Q of the signal generating circuit 64 becomes "H" to turn on the triac 54 thereby to energize the motor of the compressor 16 by the power source 50. In this case, the ON voltage $V_a$ (ON temperature) is kept constant regardless of the resistance set of the variable resistor 76. When the compressor motor 16 is driven, the coolant circulates in the cooling cyclic route so that the evaporator 22 cools the freezing chamber 6 and the first and second coolers 26 and 32 cool the freezing chamber 4. Accordingly, the temperature in the freezing chamber 6 falls so that the resistance of the thermistor increases and the voltage across the thermister increases, and the potential at the node 74 approaches to +V potential. However, the potential at the node 80 is closer to the negative power source −V by the voltage drop across the variable resistance than the potential at the node 74. Accordingly, the potential at the node 80 exceeds the potential $V_f$ if, as the resistance of the variable resistor 76 is large, a larger voltage is applied across the thermistor 44. In other words, as the resistance value of the variable resistor 76 becomes larger, the OFF voltage (OFF temperature) more falls. The operation as mentioned above is well illustrated in FIG. 8.

When the input voltage at the node 80 rises to the OFF voltage $V_b$ (OFF temperature) set by the variable resistor 76, the output signal at the output terminal Q of the control signal generating circuit 64 becomes "H" in level while the output at the output terminal Q becomes "L". The result is that the triac 54 is turned off and the compressor motor 16 stops and thus the circulation of the coolant in the cooling cyclic route also stops. Accordingly, the frost formed on the evaporator 22 is automatically defrosted at the room temperature when the temperature in the freezing chamber 6 becomes plus temperature, that is more than 0° C., till the compressor 16 is again turned on. The frost melted drops onto the dish 23 and flows into the dish 18 through the drain pipe 36. The output at the output terminal Q of the control signal generating circuit 64 is supplied to one of the input terminals of the AND gate 60. The other input terminal of the AND gate 60 receives the output signal from the output terminal Q of the control signal generating circuit 84 for defrosting control. When this output is "H" in level, the AND gate 60 is enabled and it becomes "H" level to turn the triac 52 on thereby to supply electric power to the heater 38.

In the control signal generating circuit 84, like the control signal generating circuit 64 for temperature control, the voltage applied to the node 92 follows the resistance variation of the thermistor 46, independently of the resistance value of the variable resistor 94. As the temperature rises, the resistance of the thermistor 46 decreases and the bearing voltage of the thermistor 46 becomes small and the potential at the node 98 approaches to the positive +V power source. The voltage level applied to the node 92 exceeds the reference voltage level $V_f$ so that the output terminal Q of the control signal generating circuit 84 changes to "L" in level. At this time, the AND gate 60 does not provide the ON signal to the triac 29 with the assumption that the frost is little, so that no current flows thorough the heater 15. In the freezing chamber 4, the frost is formed on the inner wall of the freezing chamber 4 every time that the door is open and close. Of the frost formed, that attached to the metal box 24 with the first cooler closely attached therearound and that attached onto the food are sublimated to move in the freezing chamber 4 to attach collectively onto the second cooler 32 and as time goes, the frost attached on the metal box 24 disapears within the inner surface of the freezing chamber 4 because it is blinded by the blind board 40. As described above, those frosts move into the second freezing chamber 32 behind the blind board 40 to attach onto the surface thereof. The frost on the second freezing chamber cooler 32 grows to be in contact with the thermistor 26 and the resistance value of the thermistor 46 abruptly increases and the voltage applied to the node 92 decreases to approach to the negative power source −V. When the reference voltage level $V_f$, the output terminal Q of the control signal generating circuit 64 becomes "H" level. In this case, the ON voltage $V_a$ (ON temperature) also becomes constant in level regardless of the resistance value of the variable resistor 94. Then, the voltage at the node 92 drops to the voltage $V_a$ while the output terminal "Q" of the temperature control signal generating circuit 84 is kept at the "H" level, that is to say, the compressor motor 16 is not operated. Only at this time, the sum logic of the AND gate 60 holds so that it produces an output signal "H" level to turn on the triac 52 to supply power from the power source 50 to the heater 38. The result is that the heater 38 is energized to heat the surface of the second cooler 32 to melt the frost on the cooler 32. The melted frost drops onto the dish 34 and then flows down through the drain pipe 36 into the dish 18, then to be evaporated.

The voltage applied to the node 98 connecting to the control signal generating circuit 84 is closer to the +V by the voltage drop across the variable resistor 94 than the potential at the node 92. Accordingly, smaller the value of the variable resistor 94, smaller the bearing voltage across the thermistor 46 must be. Otherwise, the potential at the node 98 does not exceed the reference potential $V_f$. In other words, as the value of the variable resistor 94 is smaller, the OFF voltage $V_b$ (OFF temperature) falls more. The state of the operation as mentioned above is illustrated in FIG. 9.

As described above, the refrigerator according to the invention is provided with the first and second coolers 26 and 32 in the freezing chamber 4, with the second cooler intimately attached around the peripheral wall of the freezing chamber 4 and separated from the room wall of the freezing chamber 4, having a lower temperature than that of the first cooler. As a result, the frost formed on the wall surface 24 may be reduced without decreasing the cooling surface of the inner wall of the freezing chamber 4. Additionally, the improvement of the cooling efficiency in the direct cooling type refrigerator may be ensured preventing frost being attached onto the food and an ice making dish. This leads to easy handling of food taking in and out of refrigerator. The separation of the second cooler from the chamber wall facilitates the sustaining of the temperature difference between the two coolers.

Furthermore, the defrosting operation is possible by heating the second cooler 32 and not the wall of the freezing chamber 4. Therefore, there is no need for taking out the food to exterior in the time of defrosting operation, permitting an automatic defrosting operation. An additional feature of the present invention is that the thermal capacity of the cooler may be small and the heat-radiation surface of the second cooler may be smaller than the inner wall area because the mere heating of the second cooler 32 by the electrical heater 38 can defrost. This brings about the small heat radiation loss and small heater capacitor and the power loss when the heating is made.

The disposition of the second cooler in the front of the rearmost wall of the freezing chamber makes it easy to dispose the dish.

As described above, the present invention can reliably defrost the frost attached onto the freezing chamber.

What we claim is:

1. A freezing refrigerator comprising:

a freezing chamber for storing an object to be frozen, said freezing chamber defined by contiguous top, bottom, side and rear walls and including an opening for taking the object in or out of said chamber;

a freezing chamber door member provided at the opening which is opened or closed when the object is taken in or out of said freezing chamber and for intimately closing said freezing chamber when said door member is closed;

a first cooling means which is provided at the periphery around the top, bottom and side walls of said freezing chamber to cool said freezing chamber;

a second cooling means which is disposed close to the rear wall of said freezing chamber;

a shield which is disposed between said second cooling means and said door and close to said second cooling means and is made of a heat insulative material, said shield substantially open around its periphery;

a heating means for melting frost attached to said second cooling means; and coolant supply means for supplying a coolant to said first and second cooling means to produce a temperature differential therebetween such that the surface temperature of said second cooling means is lower than that of said first cooling means;

wherein said shield defines a defrost region between said shield and said rear wall, said defrost region communicating with the rest of said freezing chamber around the periphery of said shield, whereby frost deposited on the first cooling means is migrated by air convection past said shield towards said second cooling means in said defrost region.

2. A freezing refrigerator according to claim 1, wherein said coolant supply means keeps the difference between the surface temperature of said second cooling means and that of said first cooling means not lower than 5° C.

3. A freezing refrigerator according to claim 1, wherein said heating means is an electrical heater for melting the frost formed on the surface of said second cooling means, which is supplied with electric power when coolant is not supplied to said first and second cooling means.

4. A freezing refrigerator according to claim 1, wherein said heating means is an electrical heater for melting the frost formed on the surface of said second cooling means and said second cooling means is comprised of a zig-zag form pipe line in which the heater is buried.

5. A freezing refrigerator according to claim 1, wherein a dish is disposed under said second cooling means and receives waterdrops produced when the frost attached on said cooling means is heated.

6. A freezing refrigerator according to claim 1, further comprising a detecting means for detecting the thickness of the frost attached onto said second cooling means.

7. A freezing refrigerator according to claim 1, wherein said heating means is an electrical heater for melting the frost formed on the surface of said second cooling means and said freezing refrigerator further comprises a control circuit for initiating the power supply to the heater when a value detected by said detecting means reaches a given value.

8. A freezing refrigerator according to claim 1, wherein said coolant supply means is comprised of a compressor means for converting gas coolant into a high pressure gas coolant at high temperature, a condensor means for converting the high pressure gas coolant at high temperature into high pressure liquid coolant at high temperature, and a capillary tube coupled with said condensor means and for converting the high pressure liquid coolant at high temperature into low pressure liquid coolant at ordinary temperature which in turn is supplied to said first and second cooling means.

* * * * *

UNITED STATES PATENT AND TRADEMARK OFFICE

CERTIFICATE OF CORRECTION

'ATENT NO. : 4,294,081

)ATED : Oct. 13, 1981

NVENTOR(S) : AKIO MITANI ET AL

It is certified that error appears in the above-identified patent and that said Letters Patent are hereby corrected as shown below:

On THE TITLE PAGE INSERT:

[30]---Foreign Application Priority Data

May 2, 1978 [JP] Japan.....53-52362 --.

Signed and Sealed this

*Fifth* Day of *January 1982*

[SEAL]

*Attest:*

GERALD J. MOSSINGHOFF

*Attesting Officer*

*Commissioner of Patents and Trademarks*